United States Patent [19]

May

[11] Patent Number: 5,056,977

[45] Date of Patent: Oct. 15, 1991

[54] MOBILE HOME LIFTING AND POSITIONING APPARATUS

[75] Inventor: Benjamin J. May, Calhoun, Ga.

[73] Assignee: Van L. Teems, Aragon, Ga. ; a part interest

[21] Appl. No.: 28,773

[22] Filed: Mar. 23, 1987

[51] Int. Cl.[5] ..... B66F 7/12

[52] U.S. Cl. ..... 414/12; 414/482; 414/495; 414/541; 414/589

[58] Field of Search ..... 414/12, 481, 482, 483, 414/495, 540, 541, 589, 590

[56] References Cited

U.S. PATENT DOCUMENTS

| | | | |
|---|---|---|---|
| 2,355,341 | 8/1944 | Trimbach | 414/720 |
| 3,424,325 | 1/1969 | Kaltenegger | 414/495 X |
| 3,817,401 | 6/1974 | Becker | 414/12 |
| 4,106,634 | 8/1978 | Becker | 414/495 |
| 4,137,994 | 2/1979 | Wood | 182/2 |
| 4,200,419 | 4/1980 | Rogers, Jr. | 414/12 |
| 4,461,455 | 7/1984 | Mills et al. | 254/3 |
| 4,522,548 | 6/1985 | Oswald et al. | 414/458 |

*Primary Examiner*—Robert J. Spar
*Assistant Examiner*—Janice Krizek
*Attorney, Agent, or Firm*—Kennedy & Kennedy

[57] ABSTRACT

Apparatus for lifting and positioning mobile homes has a slide movably mounted upon a track. An elevator is supported on the slide. Hydraulic cylinders are provided for independently raising and lowering opposite ends of an elevator platform and for sliding the slide and the elevator supported thereon. A utility vehicle is hitched to the slide.

8 Claims, 4 Drawing Sheets

MOBILE HOME LIFTING AND POSITIONING APPARATUS

TECHNICAL FIELD

This invention relates to apparatuses for use in erecting mobile homes at permanent home sites.

BACKGROUND OF THE INVENTION

Mobile homes and preconstructed modular houses are today transported upon roads to their permanent sites for permanent installation. This is commonly done by constructing them with spring loaded wheel assemblies that are removably mounted to I-beams that extend longitudinally beneath their floors, and with hitches by which they may be pulled by trucks. Once they arrive at their permanent site they must be positioned upon foundations, pads or upon pillars. Since the permanent sites are frequently not level, they often are positioned upon pillars of diverse heights to accommodate the contour of the terrain.

Double-wide mobile homes are built in two sections that must be joined together when set upon pillars or pillar blocks once they have been transported to their permanent ground sites. Heretofore, this has been done with sets of jacks movably positioned upon tracks that are positioned beneath the I-beams permanently mounted to the bottoms of the mobile home sections. This procedure has been beset with a number of problems including the some 16 man-hours that it has typically taken to erect a single mobile home at a permanent site. The use of jacks movably placed upon tracks has also been particularly difficult to handle and quite dangerous in practice.

Accordingly, the present invention is directed to the provision of improved apparatus for use in lifting and positioning mobile homes at permanent ground sites.

SUMMARY OF THE INVENTION

In one form of the invention mobile and modular type home lifting and positioning apparatus comprises a track and a slide supported upon the track for movement therealong. An elevator has a platform mounted above the slide by mounting means that include means for raising and lowering the platform with respect to the slide. The apparatus further includes means for moving the slide along the track.

In another form of the invention mobile and modular type home erection apparatus comprises an elongated base that is adapted to be set upon sloping ground terrain, and elevator means including a platform adapted to be urged against a bottom support member of a mobile home to be erected. The apparatus further comprises means for selectively raising and lowering opposite ends of the elevator means platform with respect to the elongated base whereby the elevator may be located substantially level while the base is located upon the sloping ground terrain. The apparatus further includes means for moving the elevator means longitudinally over the elongated base.

In yet another form of the invention mobile and modular type lifting and positioning apparatus comprises an elongated base and an elongated platform mounted for movement above the elongated track. Cylinder means are provided for independently raising and lowering opposite ends of the elongated platform with respect to the track. Additional cylinder means are provided for moving the elongated platform longitudinally with respect to the elongated track.

DETAILED DESCRIPTION

Figure 1:
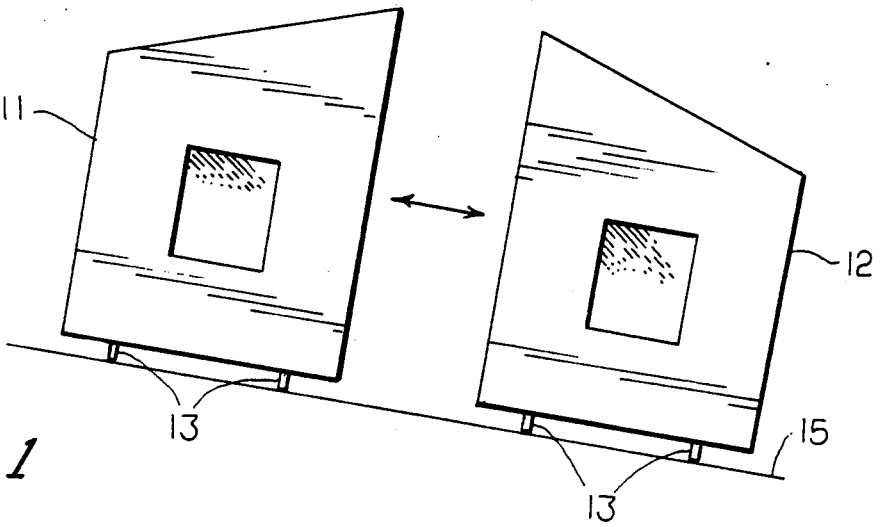
FIG. 1 is a diagrammatical view of a double wide mobile home set upon sloping terrain in preparation for permanent erection.
Figure 2:
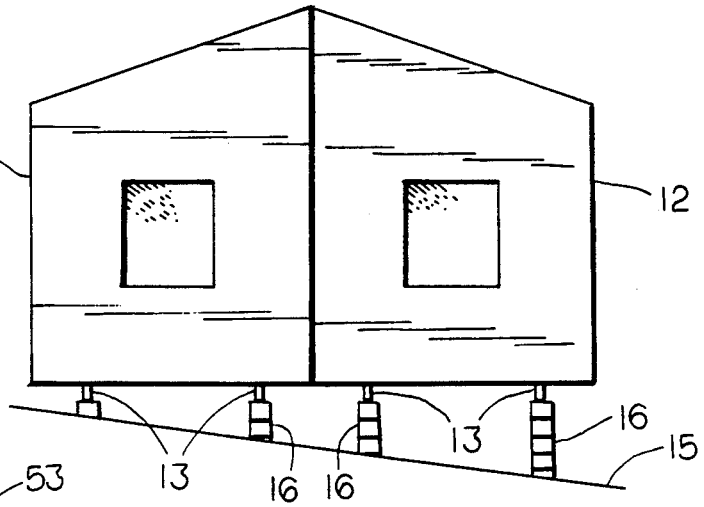
FIG. 2 is a diagrammatical view showing the mobile home illustrated in FIG. 1 in an erected and assembled configuration as a permanent residence.

With reference next to FIGS. 1 and 2, there is shown a double wide mobile home comprised of a left section 11 and a right section 12. Each section is seen to have a pair of longitudinal beams 13 mounted to their undersides for support in preventing the section floor from sagging. For purposes of illustration each mobile home section is shown positioned directly upon sloping ground terrain 15 in spaced juxtaposition preparatory to being erected and conjoined. From the position shown in FIG. 1 the two mobile home sections must be raised, leveled, joined, and permanently mounted upon pillar blocks or the like as shown in FIG. 2. In FIG. 2 it is seen that one side of the mobile home section 11 is now located flushly against a side of the other home section 12, it being understood that these sides are not permanently closed so that individual rooms and spaces may extend the entire width of the combined sections of the assembled home.

In the position shown in FIG. 2 the beams 13 are seen to be set atop stacks of pillar blocks 16 of diverse heights in order to make the floor of the home substantially level and thereby compensate for the slope of the terrain. It is the task of lifting and positioning the home sections in progressing from their FIG. 1 to FIG. 2 positions that the apparatus of the invention finds primary use. Of course, should a unitary mobile home having but one section be in need of erection, the apparatus may also be well utilized in performing such task.

With reference next to FIGS. 3 and 10–13, lifting and positioning apparatus 20 is seen to comprise an elongated channel 21 of generally U-shaped configuration having in-turned upper flanges 22. The channel functions here as a base or track and can be characterized as such. One end of the channel is closed by a stop 23 while the opposite end is open. A slide 25 is mounted for reciprocal, sliding movement along the track within the channel 22 between a position wholly within the channel and a position protruding somewhat out of the open end thereof. Sliding movement is facilitated by the provision of rollers 26 that are rotatably mounted to the slide so as to project downwardly through openings therein and onto the channel floor 21'. The slide 25 itself is also seen best from FIG. 10 to be of channel shaped construction with upper in-turned flanges 27 that are captured by and slide beneath the channel flanges 22. Though only one pair of rollers 26 is clearly shown in the drawing, others are provided at spaced intervals. That the slide flanges underlay the channel flanges enables vertical movement of the slide to raise and lower the channel.

With continued reference to FIGS. 3 and 10–13, an elevator is seen to be mounted upon the slide 25 which includes an elongated platform 30 mounted directly above the slide and channel. The length of the platform 30 is sufficient to span the space between two of the mobile home beams 13 in supporting a home or home section upon the platform. The platform 30 is mounted above the slide by two dependent legs 31 that are pivotably mounted to the platform and slide. A fork 32 is pivoted by a pivot pin 33 to each leg 31 with a fork rod 34 rotatably mounted within two collars 35 that project inwardly from the side walls of the slide.

A collar 38 is mounted to a lower portion of each of the legs 31 into each of which a hydraulic cylinder rod extends. Specifically, the cylinder rod 40' of a hydraulic cylinder 40 extends into the collar 38 of one leg 31 which is considered as being the forward leg since it is closer to the open end of the channel 21. Similarly, the cylinder rod 42' of a cylinder 42 extends into the collar mounted to the rear leg 31. Since each leg 31 is pivoted to a fork 32 that is pivoted to the slide, and since the cylinders 40 and 42 are themselves mounted to the slide, linear actuation of the cylinder rods causes the legs and forks to rise and fall and thereby raise and lower the respective ends of the platform 30 to which they are independently mounted.

The apparatus is further seen to include a pair of wheels 44 which are rotatably mounted to upright supports 49 which in turn are mounted to and depend downwardly from the sides of the platform 30. The wheels are mounted to the platform at a height such that they may be elevated to a position above the bottom of the channel 21 when the platform 30 is raised. Conversely, when the platform is lowered portions of the wheels are located below the bottom of the channel. Thus, when the elevator platform is lowered to the position illustrated in FIG. 3, with the wheels being below the bottom of the channel, this causes at least that end of the track channel to become elevated above the terrain upon which the wheels are supported.

The apparatus also includes means for driving the slide 25 within the track channel 22. This means comprises a cylinder 45 which is mounted by a mount 46 to the channel while the other end of the cylinder is mounted by a mount 48 to the slide 25. Actuation of the rod of cylinder 45 thus drives the slide 25 reciprocally within the bounds of the channel 21.

Figure 3:
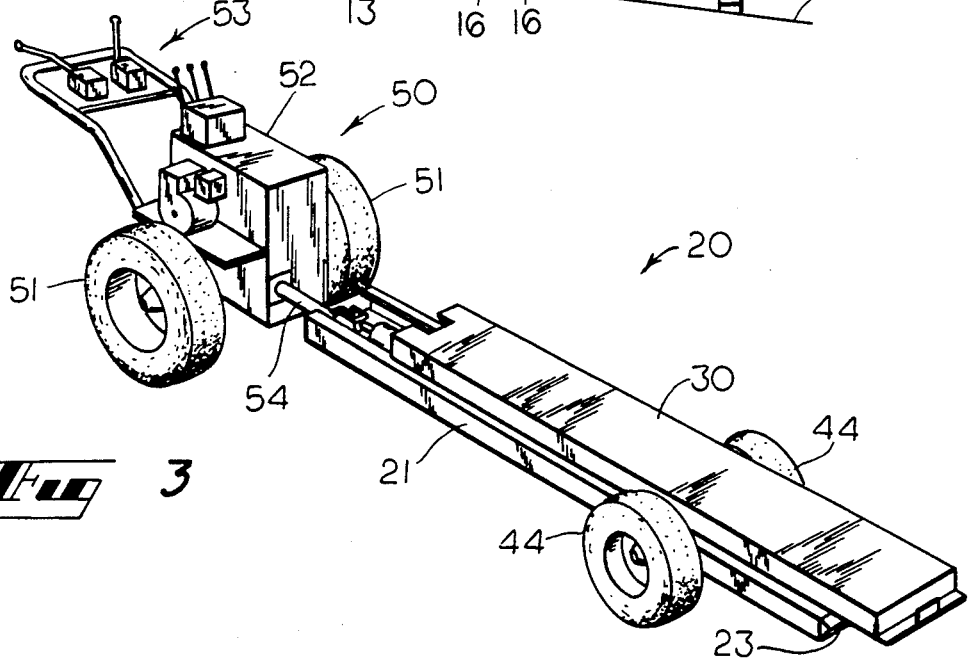
FIG. 3 is a perspective view of mobile home lifting and positioning apparatus that embodies principles of the present invention.

As shown in FIG. 3, the apparatus further comprises a utility vehicle, indicated generally at 50, which is mobile in that it has a pair of wheels 51 mounted to a frame that supports an engine or pump 52 and a set of controls indicated generally at 53. Hydraulic lines conventionally extend from the engine 52 to the apparatus cylinders. However, for clarity of illustration these have not been shown.

This utility vehicle 50 is directly linked to the lifting and positioning apparatus by a rod-shaped link 54 that is pivoted to the slide 25. Yet another cylinder 56 is coupled to the link 54 having its cylinder rod 57 mounted to a bracket 58 mounted atop the link. The other end of the cylinder is pivoted to another bracket 59 that is mounted to the slide 25. Insomuch as the longitudinal position of the slide with respect to the track in which it is housed cannot be altered unless cylinder 45 is actuated, the utility vehicle is effectively linked to the track itself though it is only directly linked to the slide. With this in mind it should be appreciated that actuation of the cylinder 56 causes the open end of the track channel to raise and lower in jack knife fashion. This is useful in elevating the open end of the track above the supporting terrain so that the entire combination can be rolled from place to place by the two pairs of wheels 44 and 51 upon the terrain, as shown in FIG. 3. At other times the track channel may be laid flat upon the supporting terrain as shown in the other figures by elevating the wheels 44 and tilting down the end of the channel adjacent the utility vehicle.

Figure 4:
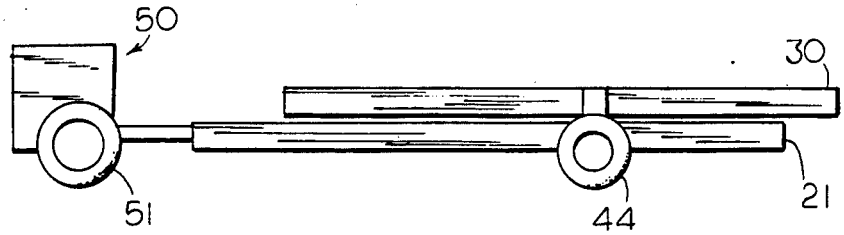
FIGS. 4–9 are diagrammatical side views of the apparatus illustrated in FIG. 3 showing various states of self articulation.
Figure 5:
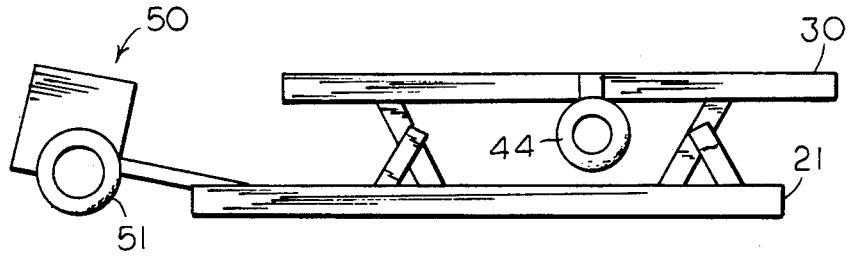

With reference next to FIGS. 4–9 the various positions are illustrated into which the apparatus may be articulated. In FIG. 4 the apparatus is shown in a position for movement and transport over supporting terrain with its elevator in a lowered position. In FIGS. 5–9 the cylinder 56 has been actuated so as to withdraw the cylinder rod and thereby cause the utility vehicle to tilt with respect to the slide and track. In FIG. 5 the cylinders 40 and 42 have both been actuated so as to cause both the forward and rear lifting cross mechanisms to raise the forward and rear portions of the platform 30 by equal distances. Thus here the terrain is leveled and the track channel 21 is also levelly positioned directly upon the terrain. The platform 30 is also at a level position oriented parallel with the track.

Figure 6:
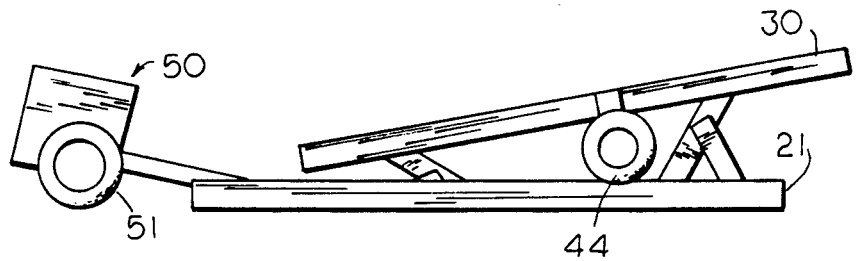
Figure 7:
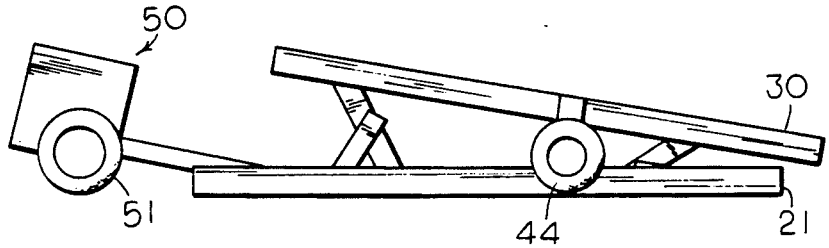
Figure 8:
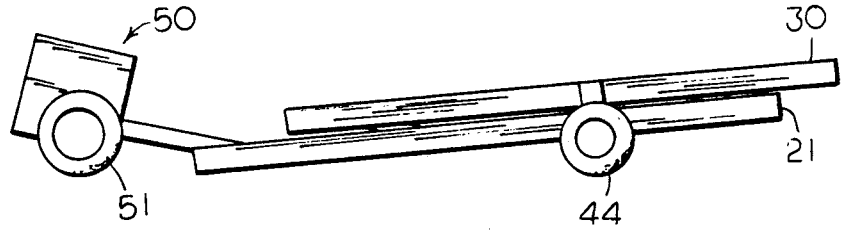
Figure 9:
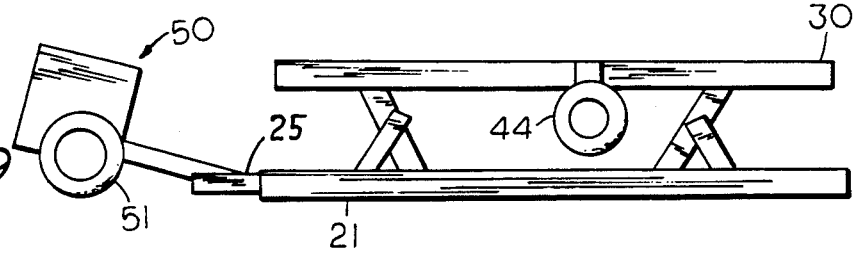
Figure 10:
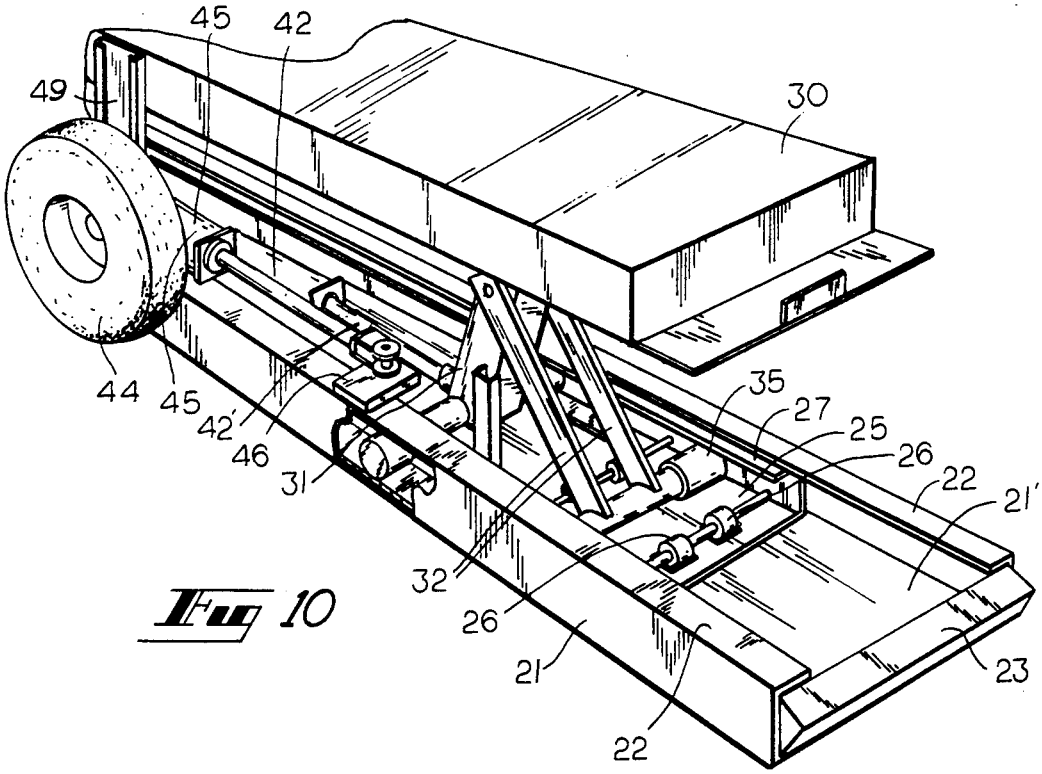
FIG. 10 is a perspective view of one end portion of the apparatus illustrated in FIG. 3.
Figure 11:
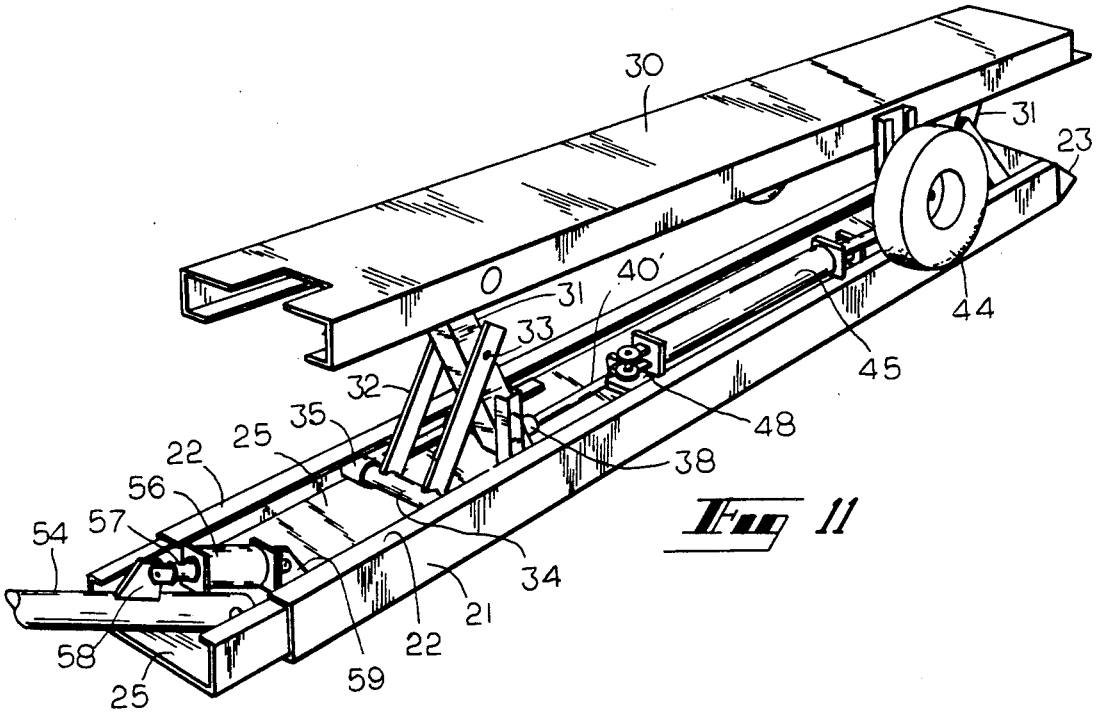
FIG. 11 is a perspective view of the apparatus as viewed from the end opposite that shown in FIG. 10.
Figure 12:
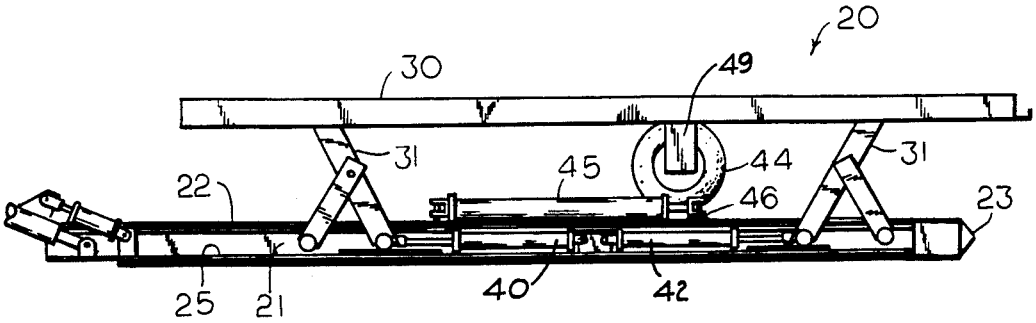
FIG. 12 is a side elevational view, shown partly in cross section, of the apparatus illustrated in FIG. 3.
Figure 13:
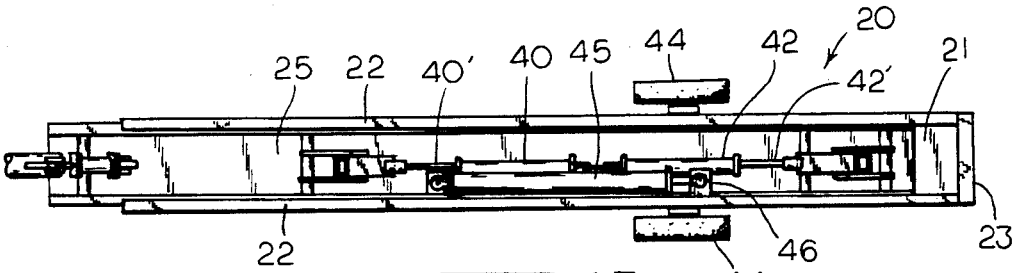
FIG. 13 is a plan view of the apparatus illustrated in FIG. 12 with an upper portion removed to reveal underlaying components.

In FIG. 6 the forward end of the platform 30 adjacent the utility vehicle is in a lowered position while the rear end is in an elevated position. Conversely, in FIG. 7 the rear end of the platform is lower than the forward end. In FIG. 8 both ends of the platform are lowered upon the track but with the track and power vehicle in a mutual tilted configuration. In FIG. 9 the slide and elevator have been moved longitudinally along the track away from its closed end. The utility vehicle 50 has accompanied this movement.

In use, the assembly may be moved as configured in FIG. 4 over terrain and into position beneath a home for erection. The platform 30 is positioned beneath the beams 13 mounted to the bottom of a mobile home. By raising the platform to some degree and by tilting the utility vehicle, the channel 21 may be placed flush upon the supporting terrain. The platform 30 may then be raised into direct engagement with the beams 13 as shown in FIG. 5. From here the platform may be elevated further and in turn cause the mobile home to be lifted.

Where the terrain is not level the degree to which the ends of the platform are raised relative to the track or channel may be adjusted so as to achieve a level position of the platform even though the track supported upon the terrain is not level. FIGS. 6 and 7 illustrate two such orientations with the platform tilted relative to the track. Here it should, of course, be understood that it is the platform that is actually level and it is the track channel 21 that is actually resting along a slope. Once this is done the slide 25 may be moved so as to project out of the open end of the track channel 21 as shown in FIG. 9 which is accompanied by movement of the utility vehicle 50, itself. In this manner it is seen that the platform 30 has been moved longitudinally with respect to the track. This is useful in relocating laterally, generally horizontally the supported mobile home and in urging it against a mating home section as shown in FIG. 2. Pillar blocks may then be erected beneath the I-beams. The apparatus may then be removed as are the wheel assemblies that were removably attached to the I-beams for transport.

It thus is seen that apparatus for lifting and positioning mobile homes, modular houses or other type structures is provided which may be used in effecting a dramatic savings in manhours and in greatly reducing the danger entailed in manually performing home erections. Though only one preferred embodiment of the invention has been specifically illustrated and discussed, it should be understood that many modifications, additions and deletions may be made thereto without departure from the spirit and scope of the invention as set forth in the following claims.

I claim:

1. Mobile home lifting and positioning apparatus comprising a track having a channel, a slide movably supported in said track channel for movement therealong, said track having stop means for preventing said slide from exiting one end of said channel, the channel end opposite said one end being open, an elevator having a platform mounted above said slide by mounting means that includes means for raising and lowering said platform with respect to said slide, and cylinder means for moving said slide along said track between a position totally within said channel and a position extending out of said channel open end.

2. Mobile home lifting and positioning apparatus comprising a track, a slide supported upon said track for movement therealong, an elevator having a platform mounted above said slide by mounting means that includes means for raising and lowering said platform with respect to said slide, means for moving said slide along said track, and a pair of wheels rotatably mounted to said platform for movement between a position above said track and a position at least partially below said track.

3. The apparatus of claim 2 further comprising linkage means for coupling an end of said slide with an ancillary vehicle, and cylinder means mounted upon said linkage means and coupled with said slide for raising and lowering an end of said track.

4. Mobile home erecting apparatus comprising an elongated base adapted to be set upon sloping ground terrain; elevator means including a platform adapted to be urged against a bottom support member of a mobile home to be erected; means for selectively raising and lowering opposite ends of said elevator means platform with respect to said elongated base whereby the platform may be located substantially level with the base located upon a slope; means for moving said elevator means longitudinally upon said elongated base; a pair of wheel rotatably mounted to said elevator means platform, and a utility power supply vehicle hitched to said base.

5. The mobile home erection apparatus of claim 4 wherein said elevator raising and lowering means comprises hydraulic cylinder means, and wherein said utility power supply vehicle carries control means for controlling said hydraulic cylinder means.

6. Mobile home lifting and positioning apparatus comprising an elongated track, an elongated platform mounted for movement above said elongated track, cylinder means for independently raising and lowering opposite ends of said elongated platform with respect to said track, a slide upon which said platform is supported, said slide being mounted for reciprocal movement along said track, and cylinder means for reciprocally moving said slide along said track so as to move said elongated platform longitudinally with respect to said elongated track.

7. The apparatus of claim 6 further comprising a pair of wheels mounted to said platform for movably supporting said track with said platform in a lowered position for movement of the apparatus from place to place.

8. The apparatus of claim 7 further comprising a mobile auxiliary vehicle hitched to an end of said slide, and cylinder means for tilting said end opposite said one end.

* * * * *